United States Patent [19]

Bussard

[11] Patent Number: 4,726,130

[45] Date of Patent: Feb. 23, 1988

[54] NEEDLEWORK FRAMING HOOP FOR WALL DISPLAY

[76] Inventor: Janice W. Bussard, 201 N. Fruitport Rd., Spring Lake, Mich. 49456

[21] Appl. No.: 42

[22] Filed: Jan. 2, 1987

[51] Int. Cl.[4] ..... D05C 1/04

[52] U.S. Cl. ..... 38/102.2; 220/95; 40/603

[58] Field of Search ..... 38/102.2; 40/617, 603, 40/152, 152.1; D8/367, 373; 248/231.2; 220/95

[56] References Cited

U.S. PATENT DOCUMENTS

| | | | |
|---|---|---|---|
| 586,947 | 7/1897 | Bucklin | 38/102.2 |
| 610,658 | 9/1898 | Maynard | 38/102.2 |
| 643,069 | 2/1900 | Post | 38/102.2 |
| 648,722 | 5/1900 | Boyer | 38/102.2 |
| 1,120,357 | 12/1914 | Austin | 38/102.2 |
| 1,318,721 | 10/1919 | Boden | 38/102.2 |
| 2,697,629 | 12/1954 | Mushrush | 220/95 X |
| 4,411,208 | 10/1983 | Nishida et al. | 38/102.2 X |
| 4,635,388 | 1/1987 | Bussard | 38/102.2 |

*Primary Examiner*—Louis K. Rimrodt
*Assistant Examiner*—J. L. Olds

[57] ABSTRACT

A needlework hoop set including a pivotable loop between opposite ends of the inner hoop; the loop operating with a mechanism that expands the inner hoop against an outer hoop.

2 Claims, 34 Drawing Figures

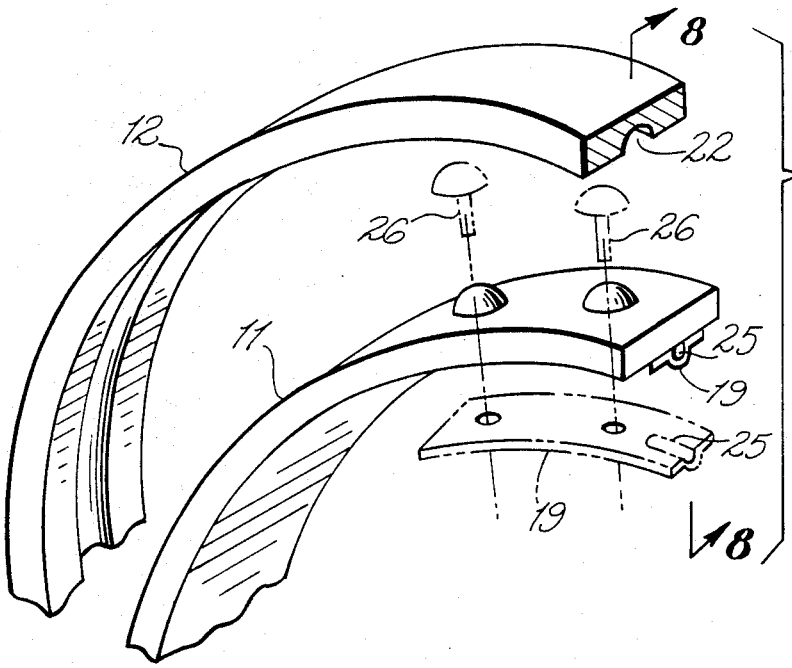
Fig. 7
Fig. 8
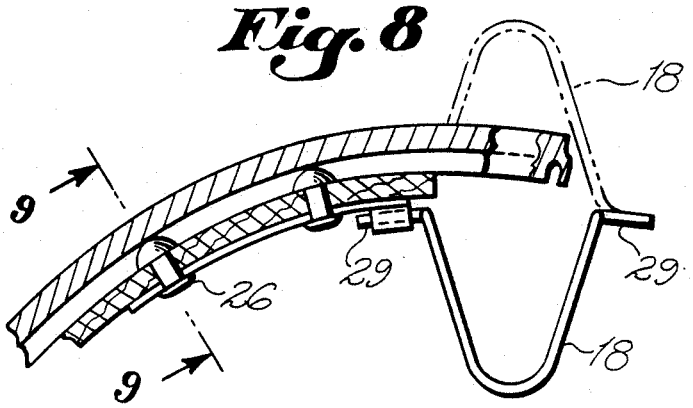
Fig. 9
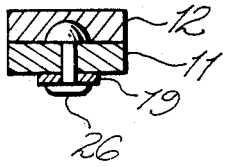
Fig. 10
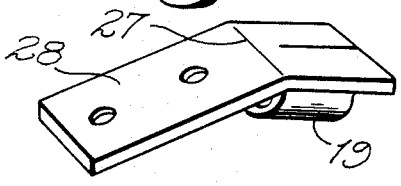
Fig. 10a
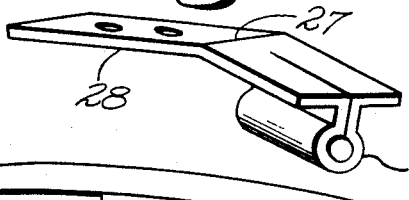
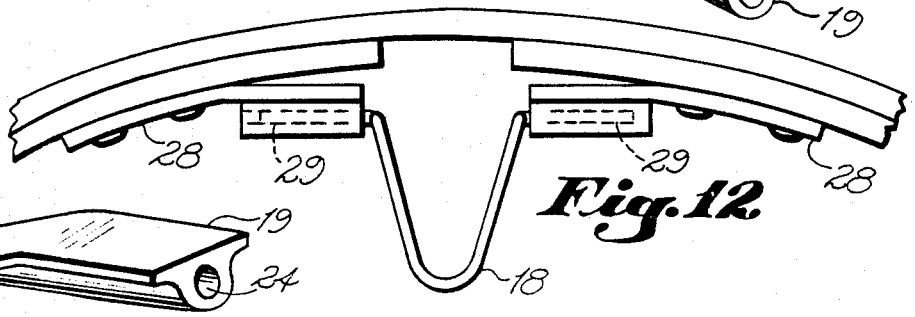
Fig. 11
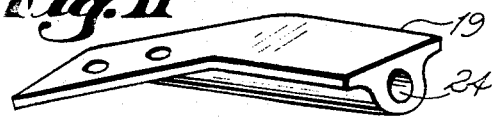
Fig. 12

37
35
39
38
40
34
36
36
37
35

29
38
29
36
40
34
36
35
37
39

35
12
11
31
26
33
30
14
14
11
32
25
19

11
30
31
31
29
19
26
29
18

NEEDLEWORK FRAMING HOOP FOR WALL DISPLAY

BACKGROUND OF THE INVENTION

1. Field of the Invention

This invention relates generally to needlework craft wherein a pair of interfitted hoops hold a fabric taut therebetween for needlework being sewn on the fabric, and afterwards the finished needlework is hung on a wall while being framed in the hoops. More specifically the present invention is a further improvement over the applicant's prior U.S. patent application, Ser. No. 823,253, filed Jan. 28, 1986, entitled: Improved Framing Hoop For Wall Hangings now U.S. Pat. No. 4,635,388.

2. Prior Art

Interfitted hoops used heretofore in the needlework art have often had the tendency, in practice, to accidentally come apart especially after they became loosened with age. This can be annoying, as it necessitates resetting the fabric and hoops together again. In the applicant's prior application, a pivotable take-up mechanism was introduced which in addition to its purpose as a wall hanging loop, also served for frictionally holding the hoops together. However, the take-up mechanism required further refinement to overcome any tendency of the hoops to snap apart when the loop was flipped between different positions.

SUMMARY OF THE INVENTION

Accordingly, it is a principal object of the present invention to provide a needlework framing hoop wherein the interfitting outer and inner hoops additionally include tongue and groove means for positive locking together and prevent accidental dislodging from one another.

Another object is to provide a needlework framing hoop having a take-up mechanism that physically expands the inner hoop for fitting the outer hoop, and additionally retains it in the expanded position.

Yet another object is to provide a needlework framing hoop wherein a pivotable, stiff wire loop of the take-up mechanism pivots about a straight axis, so does not introduce any twisting torque, when flipped, so that there is no tendency of the hoops to spring apart.

Yet a further object is to provide a needlework framing hoop having the above indicated advantages and which may be manufactured with hoops either from wood or plastic, as preferred by a manufacturer.

Other objects are to provide a needlework framing hoop which is simple in design, inexpensive to manufacture, rugged in construction, easy to use and efficient in design.

These and other objects will be readily evident upon a study of the following specification and the accompanying drawings.

BRIEF DESCRIPTION OF THE DRAWING FIGURES

FIG. 7 is an enlarged, exploded, fragmentary front perspective view of the two hoops showing a modified interlocking means from that shown in FIG. 3.

FIG. 8 is a cross-sectional view taken on line 8—8 of FIG. 7, showing the parts assembled.

FIG. 9 is a cross-sectional view taken on line 9—9 of FIG. 8.

FIG. 10 is a perspective view of another design of a loop bearing that is stamped out of sheet metal.

FIG. 10*a* is another perspective view thereof.

FIG. 11 is a perspective view of another loop bearing that incorporates the design shown in FIGS. 10 and 10*a* but which is molded of plastic.

FIG. 12 is a front elevational view of a take-up mechanism incorporating the loop bearings of FIGS. 10 and 10*a*.

Figures 13, 14, 15, 16, 17:
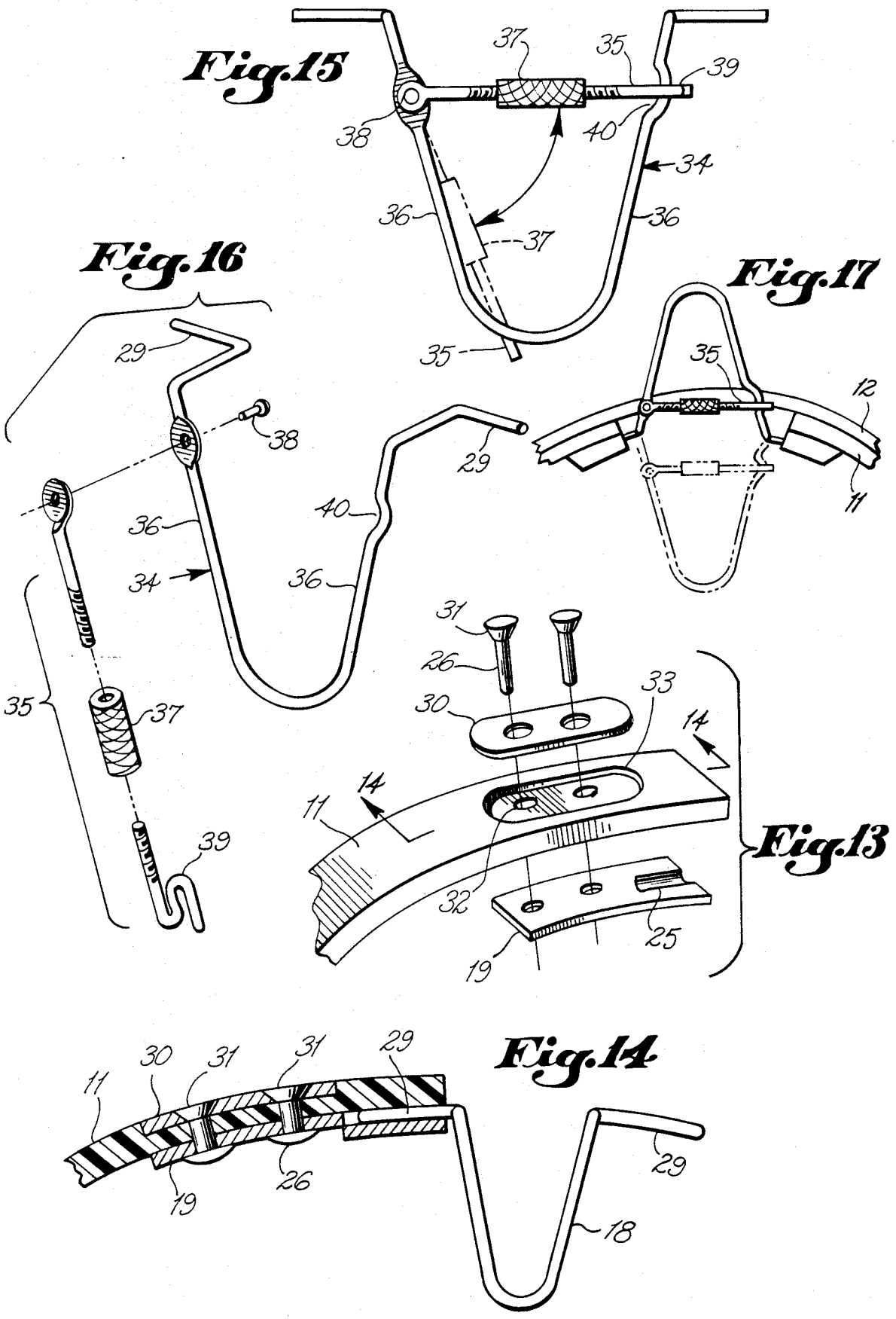

FIG. 13 is an exploded, front perspective view generally similar to FIG. 7 but shown also including a rivet head reinforcement plate.

FIG. 14 is a cross-sectional view taken on line 14—14 of FIG. 13, showing the parts assembled.

FIG. 15 is a front elevational view of a wire loop shown including a turnbuckle expansion means.

FIG. 16 is an exploded perspective view of the parts thereof.

FIG. 17 is a front elevational view of a take-up mechanism incorporating the loop and turnbuckle assembly illustrated in FIG. 15.

Figure 18:
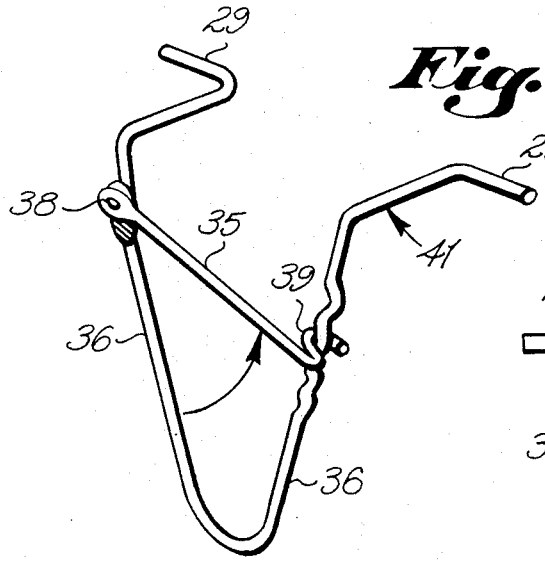

FIG. 18 is a front perspective view of a wire loop shown including a brace expansion means.

Figure 19:
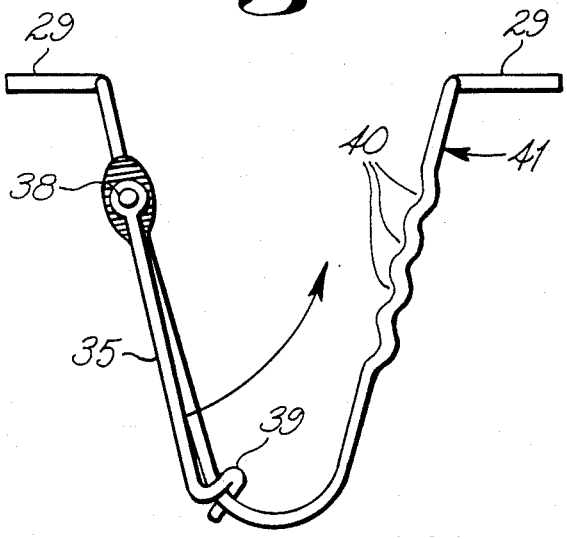

FIG. 19 is a similar view thereof showing the loop in contracted position.

Figure 20:
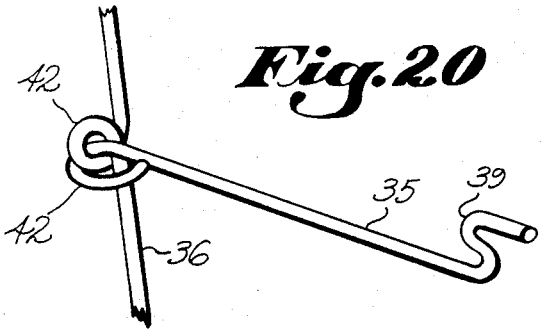

FIG. 20 is a fragmentary perspective view of a wire loop and brace having a modified design of hinge therebetween.

Figure 21:
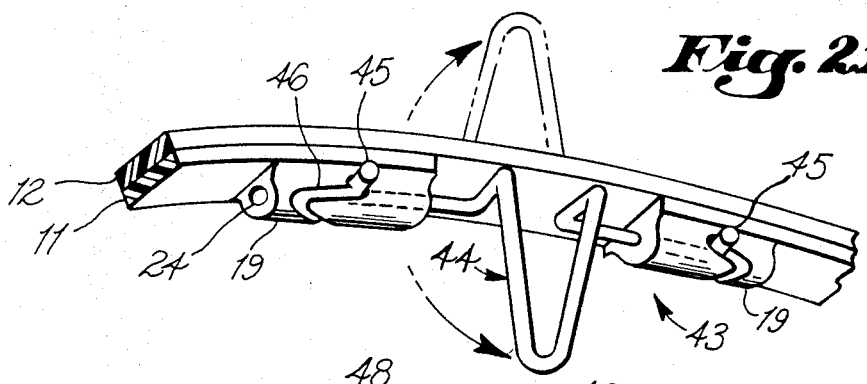

FIG. 21 is a front perspective view of another modified design of take-up mechanism that automatically expands when the loop thereof is pivoted to opposite extreme positions.

Figure 22:
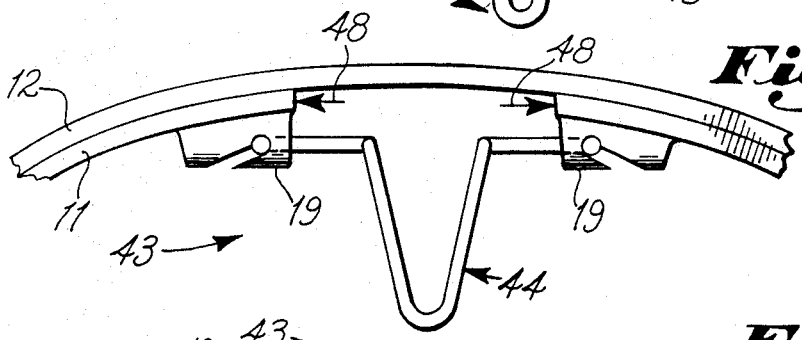

FIG. 22 is a front elevational view thereof with loop pivoted to a down position.

Figure 23:
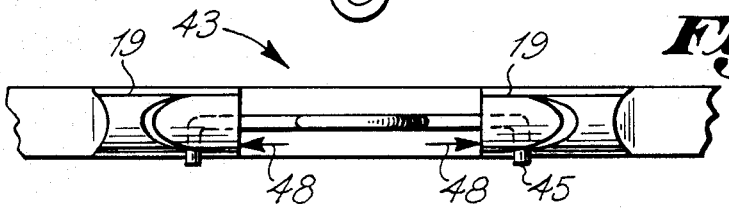

FIG. 23 is a bottom plan view thereof with loop in the down position.

Figure 24:
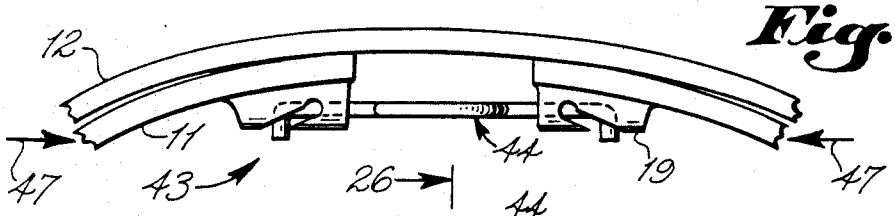

FIG. 24 is a front elevational view, similar to FIG. 22 showing the loop pivoted to a horizontal position.

Figure 25:
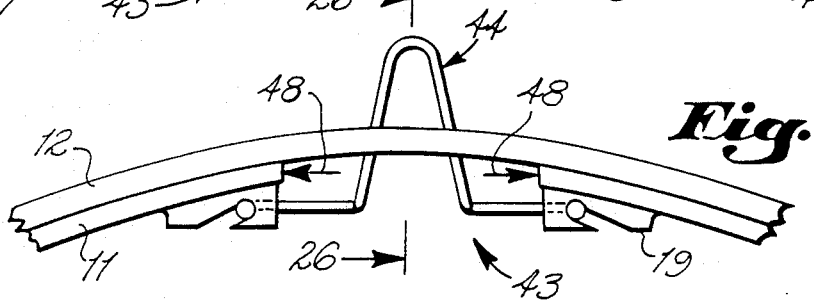

FIG. 25 is a similar view thereof showing the loop pivoted to up position.

Figure 26:
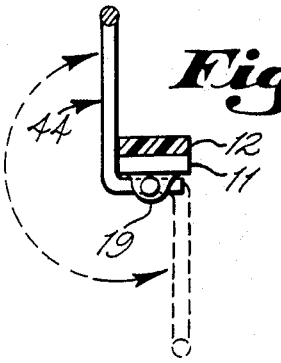

FIG. 26 is a cross-sectional view taken on line 26—26 of FIG. 25.

Figure 27:
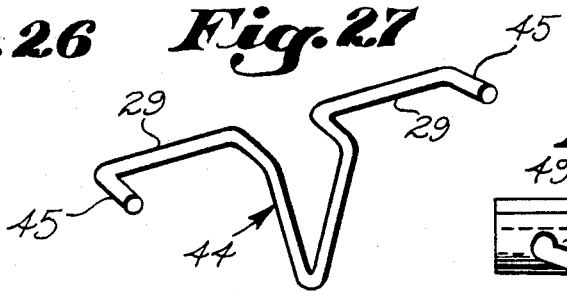

FIG. 27 is a front perspective view of the wire loop used in the design illustrated in FIGS. 21 to 26.

Figure 28:
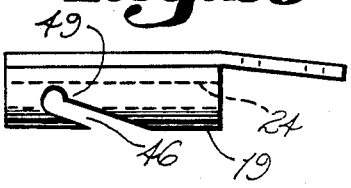

FIG. 28 is an enlarged front elevational view of the bearing design used in FIGS. 21 to 26 and which includes the angular mounting means shown in FIGS. 10 and 10*a*.

Figure 29:
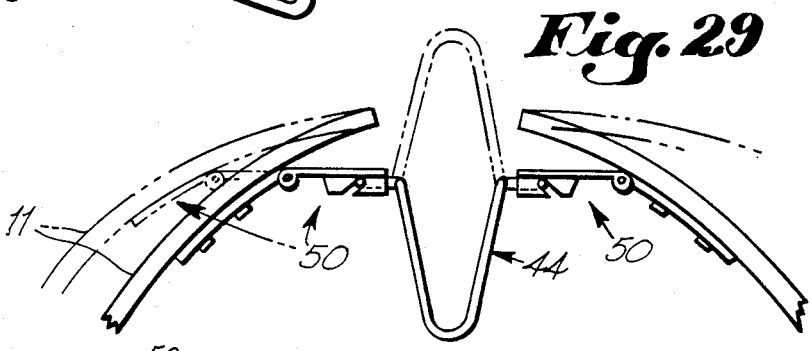

FIG. 29 is a front elevational view of another modified design of the take-up mechanism that includes all the elements shown in FIG. 24, plus a pivot means for the loop bearings.

Figure 30:
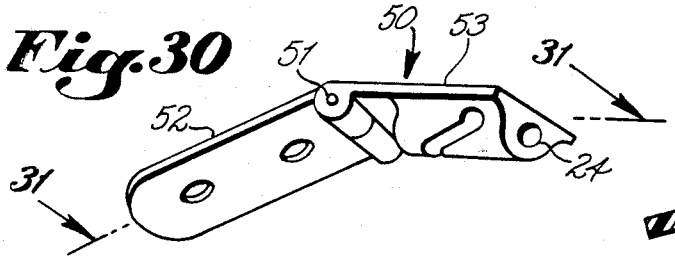

FIG. 30 is an enlarged perspective view of the bearing employed in the design shown in FIG. 29.

Figure 31:
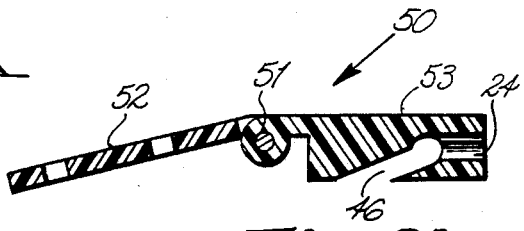

FIG. 31 is a cross-sectional view taken on line 31—31 of FIG. 30.

Figure 32:
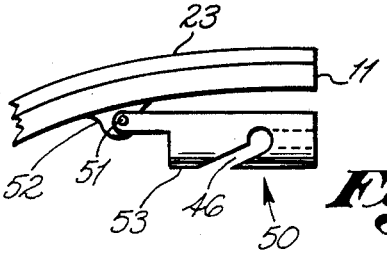

FIG. 32 is a front elevational view of a bearing of the design illustrated in FIG. 30, shown pivoted on a hinge molded on a plastic hoop.

Figure 33:
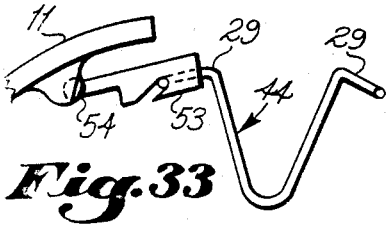

FIG. 33 is a front elevational view of a modified design of the take-up mechanism of FIG. 32, wherein a universal swivel joint substitutes the hinge.

DETAILED DESCRIPTION OF PREFERRED EMBODIMENTS

Figure 1:
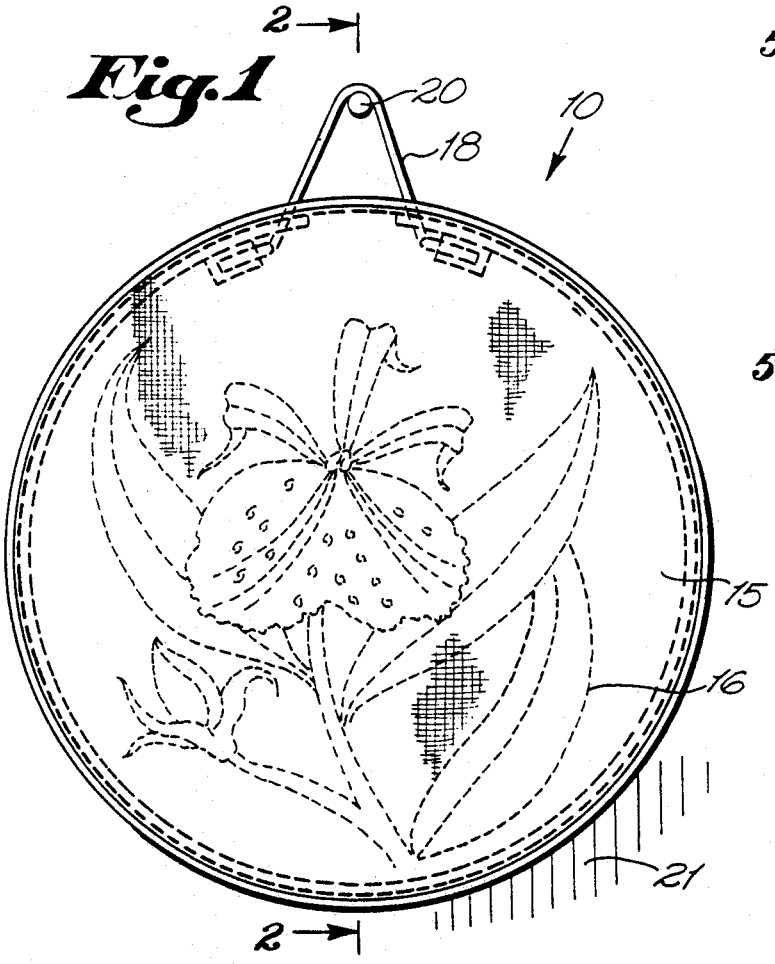
FIG. 1 is a front elevational view of one design of the invention, shown hanging on a wall.
Figure 2:
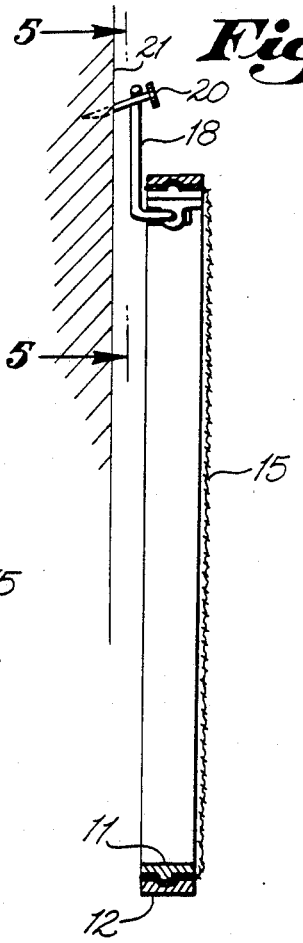
FIG. 2 is a cross-sectional view thereof taken on line 2—2 of FIG. 1.
Figure 3:
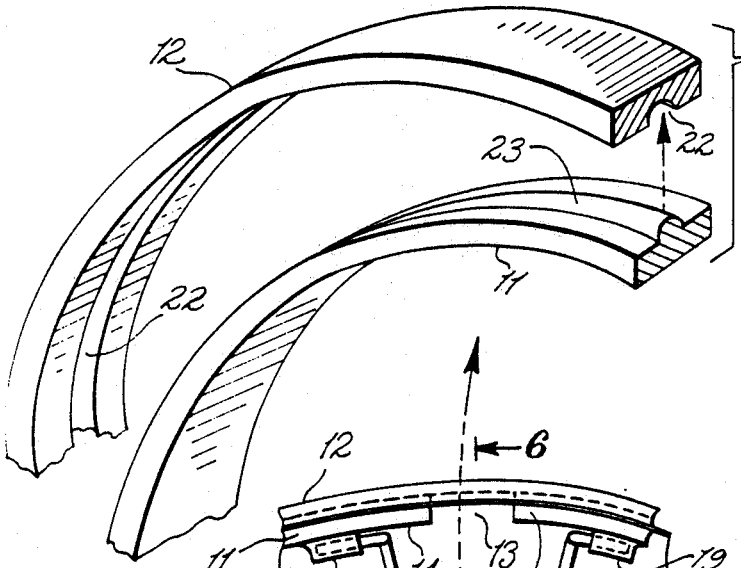
FIG. 3 is an enlarged, fragmentary perspective view of the two hoops thereof, shown separated.

Referring now to the drawings in greater detail, and more particularly to FIGS. 1 to 3 thereof, at this time, the reference numeral 10 represents a framing hoop assembly, according to the present invention, wherein there is an inner hoop 11 that fits inside an outer hoop 12. The outer hoop is fully circular while the inner hoop is incompletedly circular by having a gap 13 between opposite ends 14, thus permitting the inner hoop to expand in order to frictionally hold a fabric 15 therebetween and the outer hoop so to keep it taut while needlework 16 is sewn thereupon. A take-up mechanism 17 bridges across the gap and includes a generally "U"-shaped spring metal wire loop 18 pivotally supported at opposite ends in bearing 19 on each of the hoop ends 14. During the sewing, the loop is pivoted down, out of the way, behind the fabric, and afterwards it is pivoted upwardly for hanging on a nail 20 fastened in a wall 21. The outer hoop includes a groove 22 on its inner side for engaging a rib 23 formed along an outer side of the inner hoop, to prevent the hoops accidentally coming apart if the hoops do not fit frictionally tight together.

Figure 4:
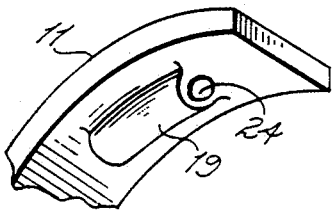
FIG. 4 is a similar view of a bearing molded on the inner hoop for pivoting the hanging loop of the device.
Figure 5:
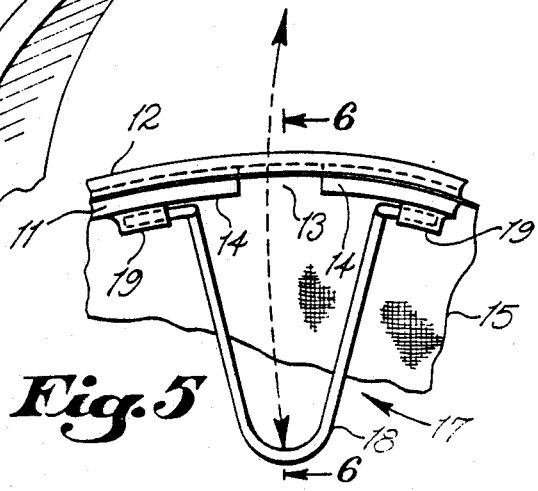
FIG. 5 is an enlarged rear elevational view of a take-up mechanism having a wire loop pivoted in downwardly position.
Figure 6:
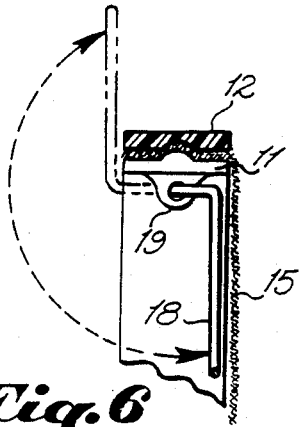
FIG. 6 is a cross-sectional view taken on line 6—6 of FIG. 5.

FIGS. 4 to 6 show that the hoops may be molded of plastic and FIG. 4 accordingly shows the bearing 19 molded on the inner hoop; the bearing having an opening 24.

FIGS. 7 to 9 show a modified construction wherein the loop may be made either of plastic or wood, and the bearing may constitute a stamped sheet metal plate having an indentation 25 in which the loop ends pivot. The plate is attached to the inner hoop by means of round headed rivets 26 which engage the groove 22 of the outer hoop, thus eliminating the need of the rib 23.

In order that the hoops do not tend to spring apart when the loop is pivoted (which can happen if the loop ends are excessively axially disaligned), the metal bearing plates may be made as shown in FIGS. 10 to 12, by having a transverse bend 27 forming an angled mounting tab 28 so that the openings 24 of the two plates align axially, and both ends 29 of the loop are also made axially aligned to pivot therein. FIGS. 10 and 10*a* show the plate stamped from sheet metal, while FIG. 11 shows it molded of plastic.

Referring now to FIGS. 13 and 14, a flat metal plate 30 is placed against the outer side of a plastic inner hoop so as to prevent the rivet heads 31 from breaking through the plastic hoop if the rivet holes 32 become worn. Thus the hoop is sandwiched between the two metal plates 19 and 30 to prevent plastic wear. The plate 30 seats inside a recess 33 so that its outer side is flush with the hoop outer side.

In FIGS. 15 to 17 a modified design of wire loop 34 includes an expandable cross brace 35 between the loop legs 36 so that the loop forcibly expands the inner hoop for locking against the outer hoop. This is accomplished by a turnbuckle 37 along the brace. One end of the cross brace pivots on a rivet 38 along one leg 36 while a yoke 39 formed on an opposite end of the cross brace, bears against the other leg to spread them apart. The yoke holds in a notch 40 formed along the latter leg. As shown in FIG. 17, when the loop is flipped upwardly, the cross brace is hidden behind the hoops.

In yet another design of expandable loop 41, shown in FIG. 18, the loop includes all the structure of the loop 34 except that it does not include a turnbuckle, however, there is a row of the notches 40 along the loop leg for selective engagement with the cross brace yoke. In FIG. 20, a pair of engaged turns 42 along a loop leg 36 and on the cross brace substitute the pivot rivet 38.

Referring now to FIGS. 21 to 28, another design of take-up mechanism 43 is shown which automatically expands the inner hoop when the loop 44 thereof is flipped into either down or up positions so as to lock the hoops together while the needlework is being sewn or else when the invention is hung up displayed on a wall. While the loop is positioned midway between these positions, the inner hoop is contracted, releasing its frictional grasp against the outer hoop so that the fabric may be adjusted, removed or replaced at such time. All this is accomplished by each end 29 of the wire loop 44 having an additional lug 45 extending at right angle thereto, and also each bearing 19 additionally having a transverse, semi-circular cross slot 46 which is angularly inclined to form a cam. The cross slot is accordingly "U"-shaped and each lug 45 travels in the cross slot causing them to pull the bearings toward each other and contract the inner ring as shown by arrows 47 when in the position shown in FIG. 24. However, when the lug gets into either end of the cross slot 46, the inner hoop is expanded as shown by arrows 48 in FIGS. 22, 23, and 25. A projection 49 locks the lug in either cross slot end for holding the inner hoop in expanded position.

FIGS. 29 to 31 illustrate yet another design of bearing 50 that includes a hinge 51 between a mounting portion 52 thereof and a loop engaging portion 53 thereof so that bearing openings 24 align axially at all times, regardless if mounted on a small or large hoop, as suggested in FIG. 29. In FIG. 32 the portion 52 is a projection molded directly on a plastic inner hoop.

Referring now to FIG. 33, another modified design of bearing is illustrated which is same as shown in FIG. 32 except that a universal swivel joint 54 substitutes the hinge 51, so as to be used with loop ends 29 that are disaligned, as shown in FIGS. 5, 14 and 17 to prevent twisting torsion.

The numerous variations of each of the invention elements, herewith presented, may be variably combined to form assemblies specifically different than those already shown in the drawings, as selected by a manufacturer. Thus, for example: the automatic take-up mechanism of FIG. 21 may be included with the groove and rivet interfit of FIG. 7 and the swivel of FIG. 33, and the like.

While various changes may be made in the detail construction, it is understood that such changes will be within the spirit and scope of the present invention, as is defined by the appended claims.

What I claim as new, is:

1. A needlework framing hoop, comprising in combination, a circular outer hoop, and a circular inner hoop therein, a gap left along said inner hoop forming opposite ends on said inner hoop, and a take-up mechanism bridging said gap being attached to said opposite ends; said take-up mechanism having expansion means to expand said inner hoop for frictional hold against an inner side of said outer loop, and said hoops including interfitting means; said interfitting means comprising a groove along said inner side of said outer hoop and a protrusion on an outer side of said inner hoop for mating therewith; said take-up mechanism comprising a pivotable "U"-shaped wire loop, a bearing on each said opposite end of said inner loop, opposite ends of said loop being pivotally received in openings of said bearings and movement means for moving said inner hoop opposite ends selectively away or toward each other; said movement means to move said loop opposite ends comprising an angularly inclined, "U"-shaped cross slot forming a cam on each said bearing and a right angle lug on each said loop end pivotable in said cross slot cam.

2. The combination as set forth in claim 1, wherein each said bearing includes a swivel joint for aligning said bearing openings with said loop ends and overcoming twisting torsion force when said loop is pivoted.

* * * * *